US010640181B1

(12) United States Patent
Decker

(10) Patent No.: US 10,640,181 B1
(45) Date of Patent: May 5, 2020

(54) WAKESURFING SYSTEMS AND METHODS

(71) Applicant: Sam Travis Decker, Spring Park, MN (US)

(72) Inventor: Sam Travis Decker, Spring Park, MN (US)

( * ) Notice: Subject to any disclaimer, the term of this patent is extended or adjusted under 35 U.S.C. 154(b) by 0 days.

(21) Appl. No.: 16/278,536

(22) Filed: Feb. 18, 2019

(51) Int. Cl.
*B63B 35/81* (2006.01)
*B63B 21/56* (2006.01)

(52) U.S. Cl.
CPC ..... *B63B 35/816* (2013.01); *B63B 21/56* (2013.01); *B63B 2021/566* (2013.01)

(58) Field of Classification Search
CPC ..... B63B 21/00; B63B 21/04; B63B 21/16; B63B 21/56; B63B 35/81; B63B 35/815; B63B 35/816; B63B 35/817
USPC ..... 114/254
See application file for complete search history.

(56) References Cited

U.S. PATENT DOCUMENTS 3,098,463 A 7/1963 Brown
3,178,127 A 4/1965 Andersen
3,195,831 A * 7/1965 Voss ..... B63B 35/816 114/254
3,303,813 A * 2/1967 Collins ..... B63B 35/817 114/254
3,326,175 A * 6/1967 Baker ..... B63B 35/816 114/254
3,498,563 A * 3/1970 Palmieri ..... B63B 35/816 114/254
3,547,371 A 12/1970 Gruseck
3,831,545 A * 8/1974 Cain ..... B63B 35/816 114/254
3,964,425 A 6/1976 Septor
4,304,372 A * 12/1981 Smith ..... B63B 35/816 114/254
4,624,141 A 11/1986 Soleau
4,878,449 A 11/1989 Smith
4,938,725 A 7/1990 Beck
4,969,610 A 11/1990 Taylor
5,632,219 A 5/1997 Fleming
6,474,588 B2 11/2002 Valverde
6,505,573 B1 1/2003 Sheikholeslam
6,666,159 B2 12/2003 Larson
7,197,998 B1 4/2007 Rice
7,665,411 B2 2/2010 Welch
8,220,405 B2 7/2012 Christensen
(Continued)

FOREIGN PATENT DOCUMENTS

WO 2011103568 A2 8/2011

*Primary Examiner* — Lars A Olson

(57) ABSTRACT

Many embodiments described herein prevent damage to a surf rope and/or watercraft due to a surf rope remaining in the water after it is released by a wakesurfer. The wakesurfing system may include a first and second reel assembly arranged and configured to retract a discarded surf rope. The first reel assembly may have a telescoping and rotatable boom and may be coupled to a side of the watercraft. The second reel assembly may be coupled to a tower, pylon, or ski hook of the watercraft. The first reel assembly may have a first cord reel coupled to a handle of the surf rope, and the second reel assembly may have a second cord reel coupled to a proximal location of the surf rope. The first and second cord reels, and the surf rope, may be in a retracted position when not in use, and in an extended position when used by a wakesurfer.

20 Claims, 9 Drawing Sheets

(56) References Cited

U.S. PATENT DOCUMENTS

| | | | |
|---|---|---|---|
| 8,522,706 | B2 | 9/2013 | Larson |
| 9,108,706 | B2 | 8/2015 | Doerr |
| 9,592,890 | B2 | 3/2017 | Christensen |
| 2006/0027155 | A1 | 2/2006 | Welch |
| 2007/0023557 | A1 | 2/2007 | Rankin |
| 2008/0054118 | A1 | 3/2008 | Czajkowski |
| 2011/0143846 | A1 | 6/2011 | Davis |
| 2012/0060740 | A1 | 3/2012 | Stevens |
| 2012/0132121 | A1 | 5/2012 | Scheper |
| 2015/0014379 | A1 | 1/2015 | Jesewitz |

* cited by examiner

WAKESURFING SYSTEMS AND METHODS

BACKGROUND

Field

Various embodiments disclosed herein relate to wakesurfing systems. Certain embodiments relate to reel assemblies for wakesurfing systems.

Description of Related Art

Wakesurfing is a water sport where an individual uses a wakesurfing board to surf the wake created by a boat. To begin wakesurfing, a person typically enters the water behind the boat and holds onto a surf rope attached to the boat. As the boat accelerates, the rider is pulled to a standing position atop the wakesurfing board, at which point the rider releases the surf rope and begins surfing the wake. The sport is quickly gaining popularity but is faced by one major issue: how to best deal with the surf rope both before and after it is released by a rider. The two presently existing solutions are using an additional person to distribute and collect the discarded rope or leave the rope in the water during the ride. The use of a person to collect the rope is only an option when an additional person is present, thus requiring at least two people present on the boat at all times. Leaving the surf rope in the water during the ride brings a host of potential issues, including wear/damage to the rope, rope drag interfering with the wake, and the possibility of the rope getting caught in the propeller and causing serious damage to the watercraft. Therefore, there is a need for a solution to address the shortcomings as described above.

SUMMARY

The current invention advances the sport of wakesurfing in a novel way by facilitating retraction of the surf rope after it is released by the wakesurfer.

This disclosure includes a variety of wakesurfing system embodiments. Some embodiments may include a wakesurfing system comprising a first reel assembly arranged and configured to couple to a first location on a watercraft and a second reel assembly arranged and configured to couple to a second location on the watercraft. The first reel assembly may have a first cord reel having a first end arranged and configured to couple to the first reel assembly and a second end arranged and configured to couple to a distal location of a surf rope, wherein the distal location may be located adjacent to a handle of the surf rope. The second reel assembly may have a second cord reel having a first end arranged and configured to couple to the second reel assembly and a second end arranged and configured to couple to a proximal location of the surf rope, wherein the proximal location may be between the distal location and the second reel assembly.

The wakesurfing system solves the aforementioned issue of how to handle a discarded surf rope by using the first and second reel assemblies to "pull in" (retract) the surf rope after it is released by a rider. In some embodiments, the first reel assembly may be arranged and configured to retract the handle of the surf rope back so that the handle is adjacent the first reel assembly, and therefore no longer in the water. In some embodiments the second reel assembly may be arranged and configured to retract the proximal location of the surf rope back so that the proximal location is adjacent the second reel assembly and the surf rope is not located along a side or rear surface of the watercraft. The retraction of the handle and proximal location of the surf rope results in the surf rope being pulled out of the water so that it is no longer at risk of damage, getting caught in the propeller, or interfering with the wake of the watercraft.

In some embodiments, the first reel assembly may be coupled to a first location and the second reel assembly may be coupled to a second location on a watercraft, wherein the first location may be a cleat located on the watercraft and the second location may be a tower extending above the watercraft. In many embodiments the cleat may be located on the side of the watercraft, thus, described differently, the first reel assembly may be arranged and configured to be closer to a water surface than the second reel assembly. In some embodiments the first reel assembly may comprise a clamp arranged and configured to couple to the cleat, thus coupling the first reel assembly as a whole to the watercraft. Many embodiments of the wakesurfing system may be compatible with various types of boat cleats, including static and folding cleats.

In some embodiments, the first reel assembly may comprise a boom arranged and configured to allow the first cord reel to pass through an internal or external portion of the boom. The boom may comprise one or more guides located along a length of the boom to thereby guide the first cord reel through the boom, and may further comprise one or more rollers located at a distal end of the boom to thereby guide the first cord reel out and away from the distal end of the boom. The guides and rollers may also act to protect the first cord reel from wear that could result from rubbing against the internal portion and/or distal end of the boom, as well as prevent the first cord reel from twisting within the boom.

In many embodiments the boom may be arranged and configured to telescope such that when the boom is in an elongated position the boom defines a first length and when the boom is in a retracted position the boom defines a second length that is shorter than the first length, such that the length of the boom may vary from three to five feet depending on the level of elongation or retraction. In many embodiments the boom may define a length of about four feet. In some embodiments the boom may define a length not between three and five feet, and may instead be shorter or longer. The boom may be arranged and configured to extend perpendicular to the side of the watercraft in many embodiments, and the first reel assembly may comprise a first pivot mechanism located along a proximal portion of the first reel assembly. In some embodiments, the first pivot mechanism may be arranged and configured to allow for a plurality of rotation positions of the first reel assembly. For example, the first pivot mechanism may be arranged and configured to rotate the first reel assembly and boom upward so that the first reel assembly protrudes up and away from the watercraft. In many embodiments, the first reel assembly may be arranged and configured to rotate along a first axis and the second reel assembly may be arranged and configured to rotate along a second axis that is different than the first axis. This rotation feature may be useful to watercraft operators for greater ease of storage when the watercraft is not in use, as well as allowing the first reel assembly to remain coupled to the watercraft when the watercraft is not being used for wakesurfing.

In some embodiments, the first reel assembly comprises a first spring reel and the second reel assembly comprises a second spring reel. In some embodiments the first spring reel may produce a tension of about five pounds on the first cord reel.

BRIEF DESCRIPTION OF THE DRAWINGS

These and other features, aspects, and advantages are described below with reference to the drawings, which are intended to illustrate, but not to limit, the invention. In the drawings, like reference characters denote corresponding features consistently throughout similar embodiments. Various components in the drawings may not be drawn to scale.

DETAILED DESCRIPTION

Figure 1A:
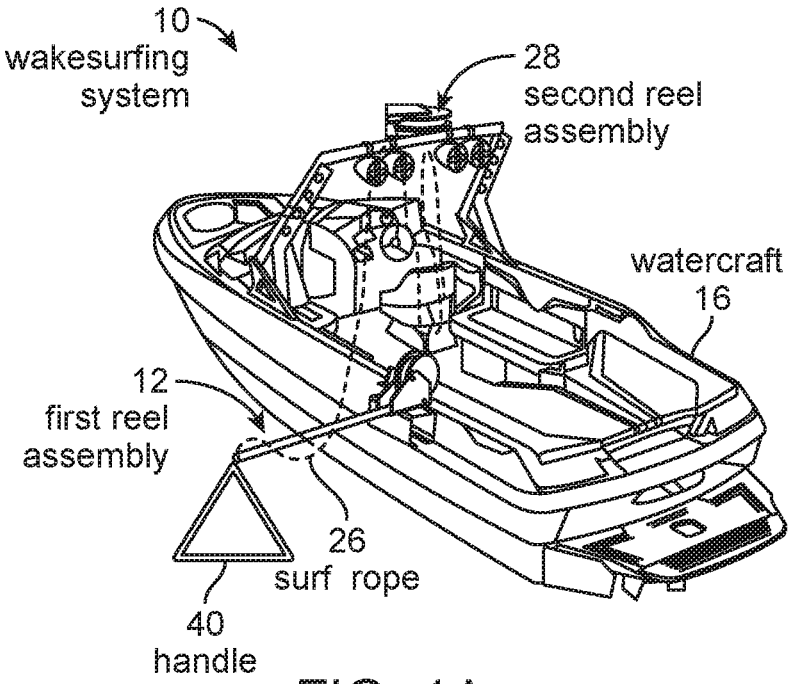
FIG. 1A illustrates a perspective view of a wakesurfing system wherein the cord reels and surf rope are in a retracted position, according to some embodiments.

Although certain embodiments and examples are disclosed below, inventive subject matter extends beyond the specifically disclosed embodiments to other alternative embodiments and/or uses, and to modifications and equivalents thereof. Thus, the scope of the claims appended hereto is not limited by any of the particular embodiments described below. For example, in any system or device disclosed herein, the acts or operations of the system or device may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, methods, and/or procedures described herein may be embodied as integrated components or as separate components.

For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

INDEX OF COMPONENTS

10—Wakesurfing system
12—First reel assembly
14—First location
16—Watercraft
18—First cord reel
20—First end
22—Second end
24—Distal location
26—Surf rope
28—Second reel assembly
30—Second location
32—Second cord reel
34—First end
36—Second end
38—Proximal location
40—Handle
42—Side
44—Rear
46—Cleat
48—Tower
50—Boom
52—Internal portion
54—First length
56—Second length
58—First pivot mechanism
60—Proximal portion
62—Clamp
64—One or more guides
66—One or more rollers
68—Distal end
70—First spring reel
72—Second spring reel
74—First axis
76—Second axis
78—Water surface

Introduction

Traditional wakesurfing practices involve having an extra person on the boat to pull in the discarded surf rope or simply leaving the rope in the water during the duration of the ride. A rope left in the water causes numerous problems for the boat driver and the rider, including creating drag that interferes with the wake and the quality of the ride, and, more dangerously, getting caught in the boat's propeller. Both of these potential issues can significantly impact the wakesurfing experience for the driver and rider, and the previous solution required the presence of an additional person to pull in the rope. The wakesurfing system of this application solves the problems of the surf rope in wakesurfing without requiring an additional person, thereby allowing more freedom for wakesurfing enthusiasts to enjoy their sport. Additionally, the system described herein is configured to present the rope to the rider without the assistance of another person. As such, this greatly decreases the time to restart the rider after a falling, etc. Various embodiments herein describe a system comprising multiple reel assemblies that operate to retract the discarded surf rope from the water surface during a ride.

System Embodiments

Figure 1B:
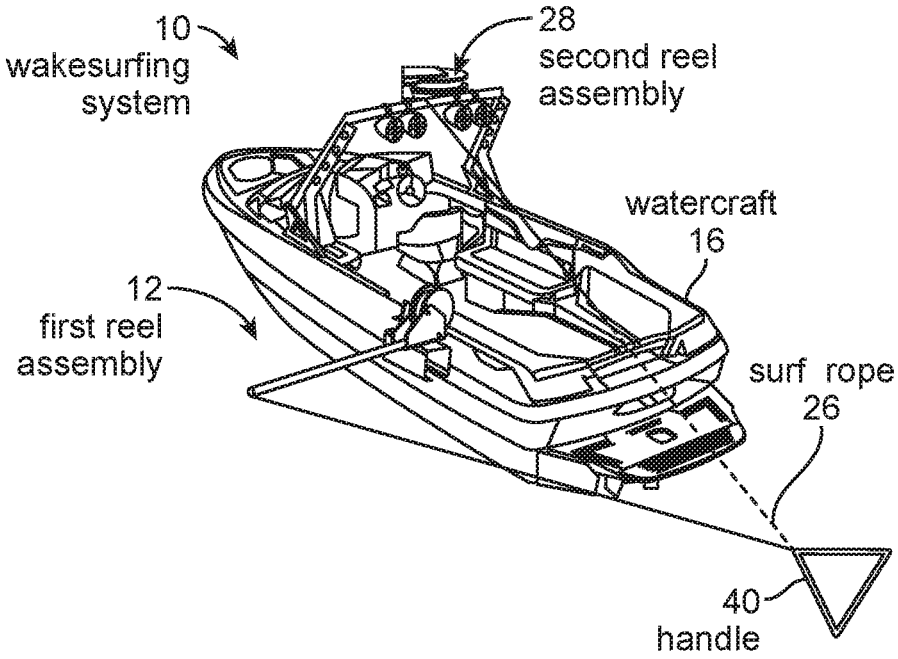
FIG. 1B illustrates a perspective view of a wakesurfing system wherein the cord reels and surf rope are in an extended position, according to some embodiments.

FIGS. 1A and 1B illustrate wakesurfing system 10. As shown, the system 10 may include a first reel assembly 12 and a second reel assembly 28, as well as a watercraft 16, a surf rope 26, and a handle 40. In some embodiments, the handle 40 may comprise a triangle shape, but in other embodiments may comprise any other suitable shape and/or form. In some embodiments, the watercraft 16 may comprise a variety of boats and/or vessels suitable for water sports.

FIG. 1A illustrates the system 10 in a retracted position and FIG. 1B illustrates the system 10 in an extended position, as it would be when a rider is holding on to the surf rope 26. FIG. 1A shows the handle 40 adjacent to the first reel assembly 12 and the surf rope 26 out of the water, thus not at risk of getting caught in the propeller or creating drag and interfering with the wake. In some embodiments, the retracted position may comprise the surf rope gathered in the boat or suspended over the watercraft, depending on the length of the surf rope and extent of retraction. It should be appreciated that the rope 26 may be configured to provide a safe distance to carry the rider behind the watercraft 16. In some embodiments, the surf rope 26 and handle 40 may move into the retracted position of FIG. 1A when the rider drops the surf rope 26 after successfully standing up on his or her wakeboard and beginning to wakesurf. In some embodiments the driver may activate retraction. Alternatively, retraction may be activated after a predetermined amount of time has passed following release of the surf rope 26 by the rider. A sensor(s) of the wakesurfing system 10 may recognize release of the surf rope 26 by a decrease in tension on the surf rope 26, in some embodiments. A spring mechanism of the system 10 may facilitate retraction, in some embodiments. In some embodiments the system 10 may be released from retraction and allowed to extend after a rider falls and/or to start another ride. In some embodiments, the retraction is accomplished via an electric motor, an engine, hydraulics, and the like.

Figure 2:
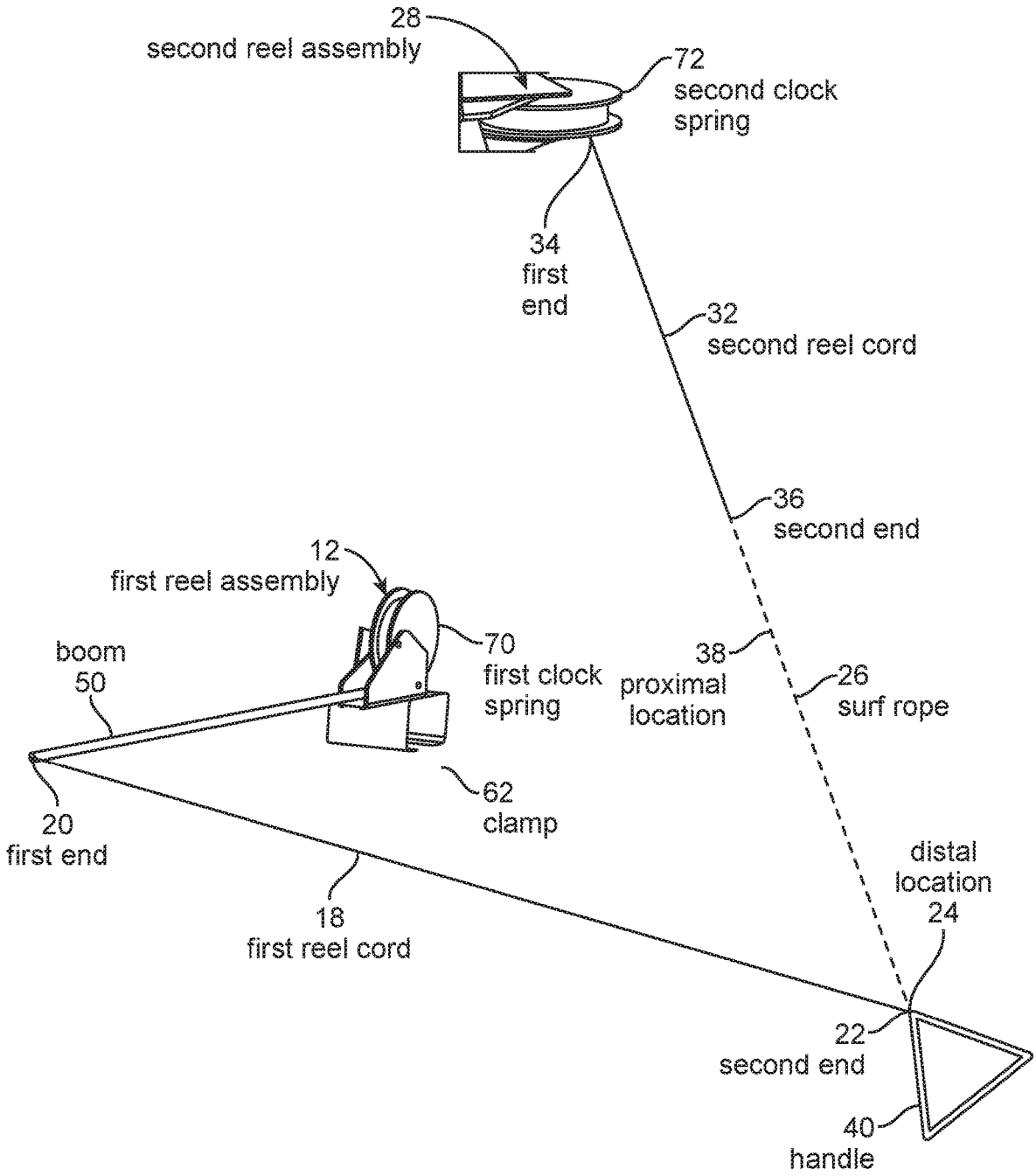
FIG. 2 illustrates a perspective view of both reel assemblies, both cord reels, and the surf rope, according to some embodiments.

FIG. 2 illustrates, in greater detail, the relationship between the first reel assembly 12, the second reel assembly 28, and the surf rope 26. In some embodiments, the first reel assembly 12 may comprise a first spring reel 70, a clamp 62, a boom 50, and a first cord reel 18. In some embodiments, the second reel assembly 28 may comprise a second spring reel 72 and a second cord reel 32. The first cord reel 18 may comprise a first end 20 and a second end 22, wherein the first end 20 may be adjacent to the first reel assembly 12 and the second end 22 may be adjacent a distal location 24 of the surf rope 26. In some embodiments, the distal location 24 may be adjacent the handle 40 of the surf rope 26. In some other embodiments, the distal location 24 may be a location on the handle 40. The second cord reel 32 may comprise a first end 34 adjacent to the second reel assembly 28 and a second end 36 adjacent a proximal location 38 of the surf rope 26. In some embodiments, the second end 36 may be coupled to the proximal location 38. In some embodiments, the first reel assembly 12 may be arranged to retract distal location 24 and/or the handle 40 and the second reel assembly 28 may be arranged to retract a proximal location 38 of the surf rope 26 at an appropriate time and/or situation, thus pulling the handle 40 and surf rope 26 up and out of the water. It should also be appreciated that either the first reel assembly 12 and/or the second reel assembly 28 may be coupled at any location on the watercraft 16, such as the top of the tower, a pylon near the stern of the watercraft, ski hook located on the stern of the watercraft 16, and/or a cleat 46.

In some embodiments when the wakesurfing system 10 is in an extended position, the first cord reel 18 and second cord reel 32 may not be fully extended. That is to say, the first cord reel 18 may not be virtually completely unwound from the first spring reel 70, and the second cord reel 32 may not be virtually completely unwound from the second spring reel 72, in some embodiments. In some embodiments the first cord reel 18 and second cord reel 32 may be wound and/or unwound from the first spring reel 70 and the second spring reel 72, respectively, in order to adjust the length of the surf rope 26 available to the rider. The ability to adjust the length of available surf rope 26 may be important for use of the system 10 with different types and/or sizes of boats and ropes. For example, some boats may require a longer length of surf rope 26 to get a rider to the "sweet spot" of the wake, and the ability to "let out" more or pull in excess rope via the spring reels 70 and 72 allows the system 10 to adapt to a multitude of possible watercrafts and ropes.

Figure 3A:
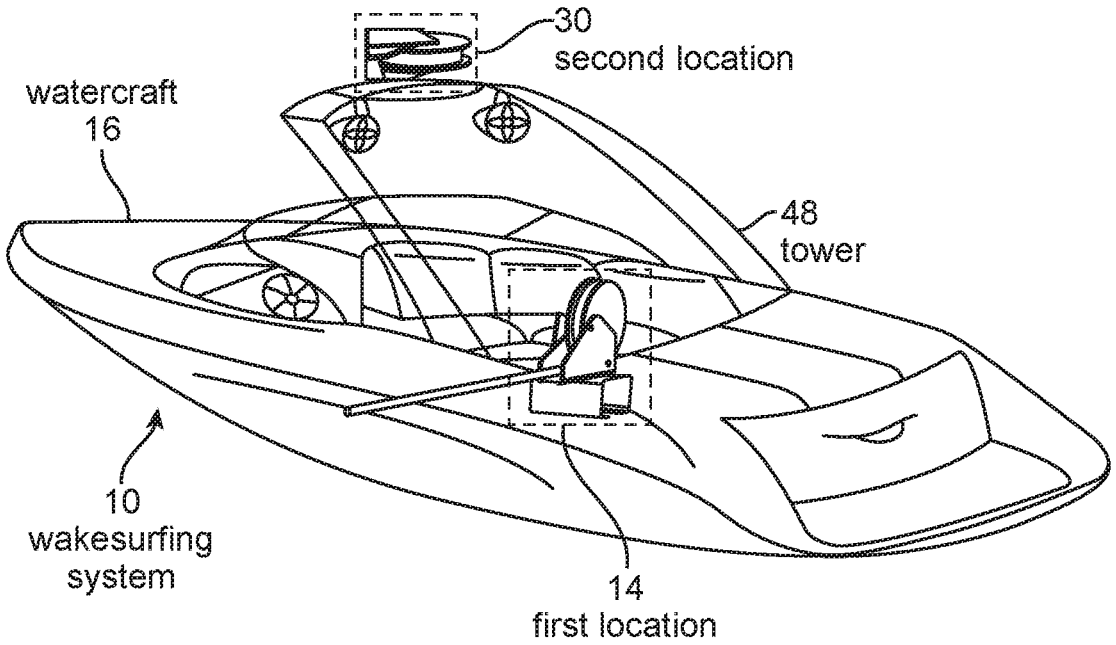
FIG. 3A illustrates a perspective view of a wakesurfing system with a first and second location, according to some embodiments.
Figure 3B:
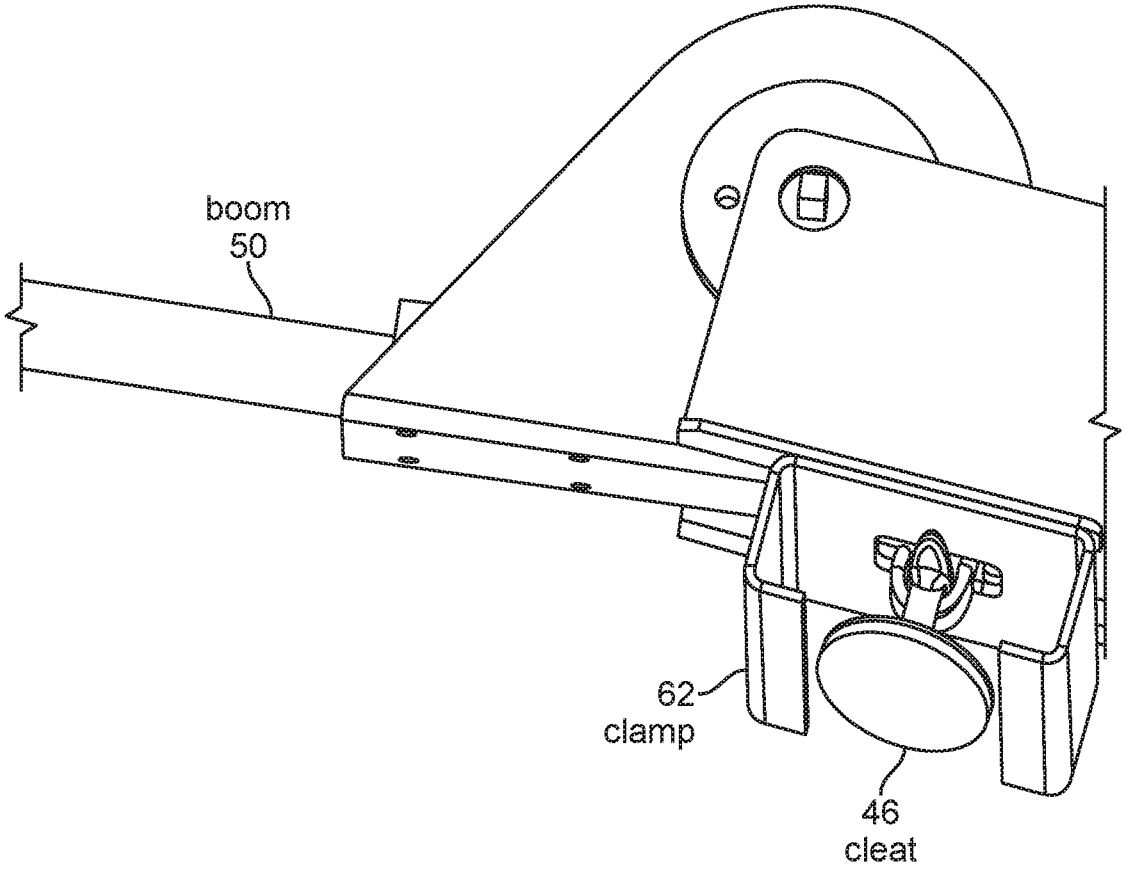
FIG. 3B illustrates a bottom perspective view of the first location with a boat cleat and the first reel assembly, according to some embodiments.
Figure 6:
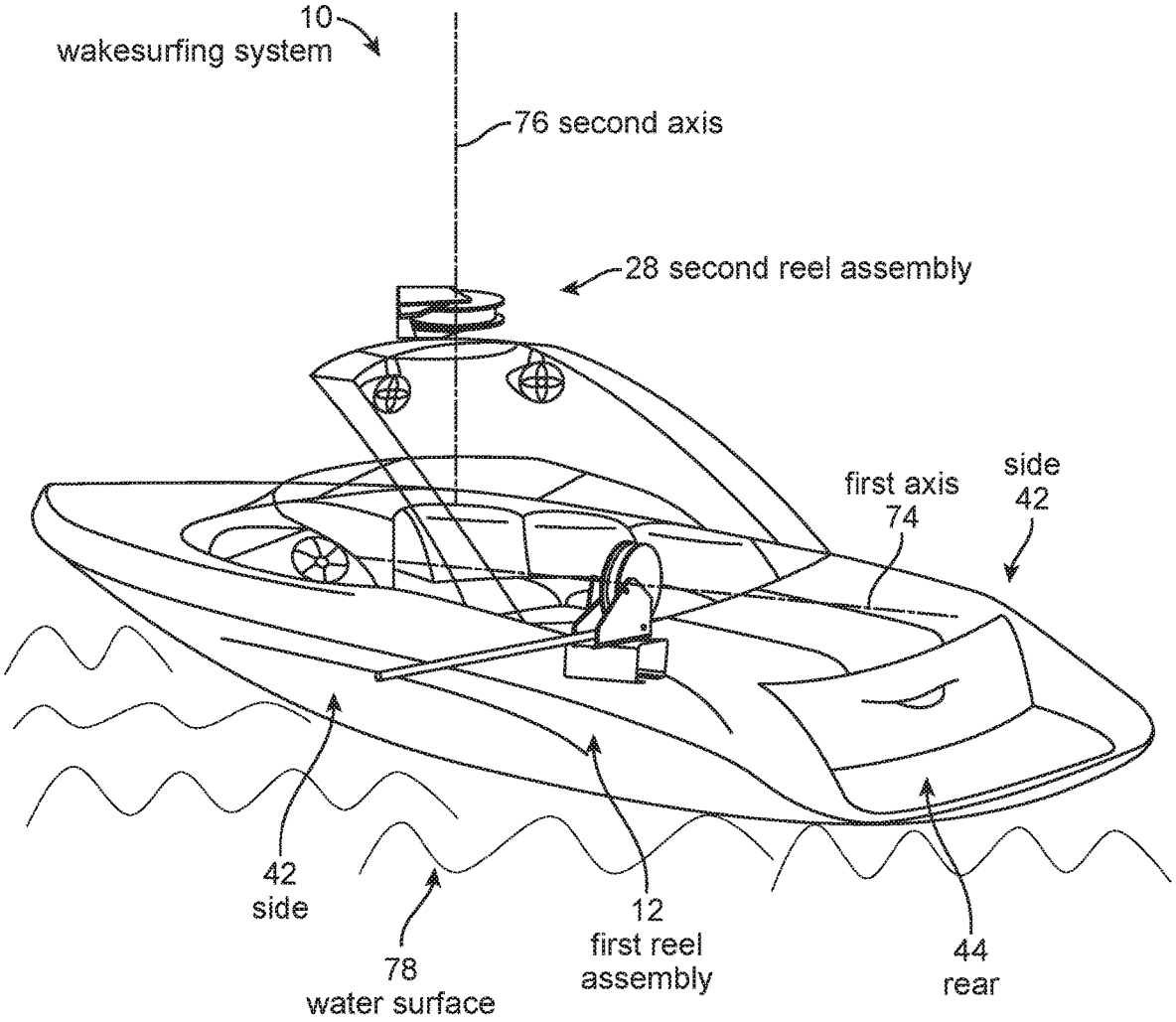
FIG. 6 illustrates a perspective view of the wakesurfing system with axes drawn to illustrate rotation of the reel assemblies, according to some embodiments.

FIG. 3A illustrates the first location 14 and second location 30 of the wakesurfing system 10, wherein the first location 14 is the area of attachment for the first reel assembly 12 and the second location 30 is the area of attachment for the second reel assembly 28. In many embodiments, the first location 14 is located on the side of the watercraft 16, and the second location 30 is the tower 48 of the watercraft 16. FIG. 3B shows the first location 14 in greater detail and illustrates that, in many embodiments, a clamp 62 of the first reel assembly 12 may be arranged and configured to couple to a cleat 46 located on the watercraft 16, thus coupling the first reel assembly 12 to the watercraft 16. In some embodiments the cleat 46 may be a static cleat; alternatively, the cleat 46 may be a foldable cleat. As shown by FIG. 3A, in many embodiments the first reel assembly 12 may be arranged and configured to be closer to a water surface than the second reel assembly 28. Though FIG. 3A, as well as FIGS. 1A, 1B, and 6, depict the first reel assembly 12 coupled to the port side of the watercraft 16, in some embodiments the first reel assembly 12 may couple to the starboard side of the watercraft 16.

Figure 4A:
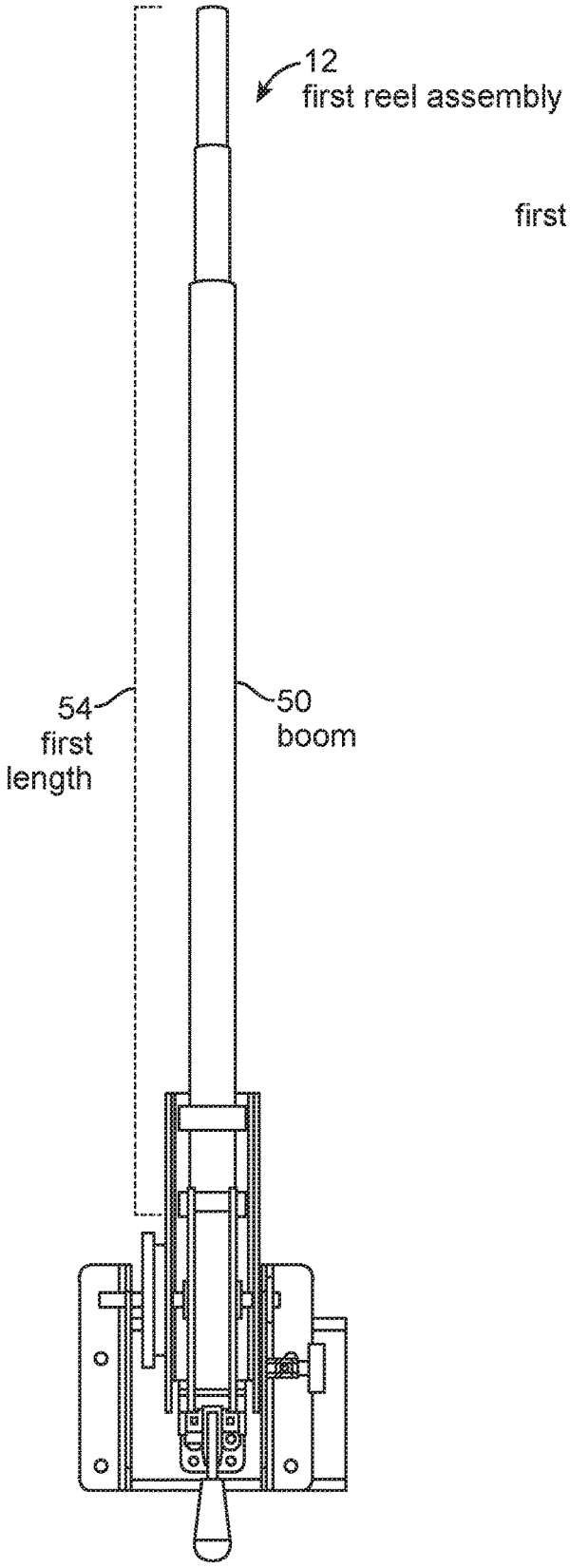
FIG. 4A illustrates a top perspective view of the first reel assembly and boom in an elongated position, according to some embodiments.
Figure 4B:
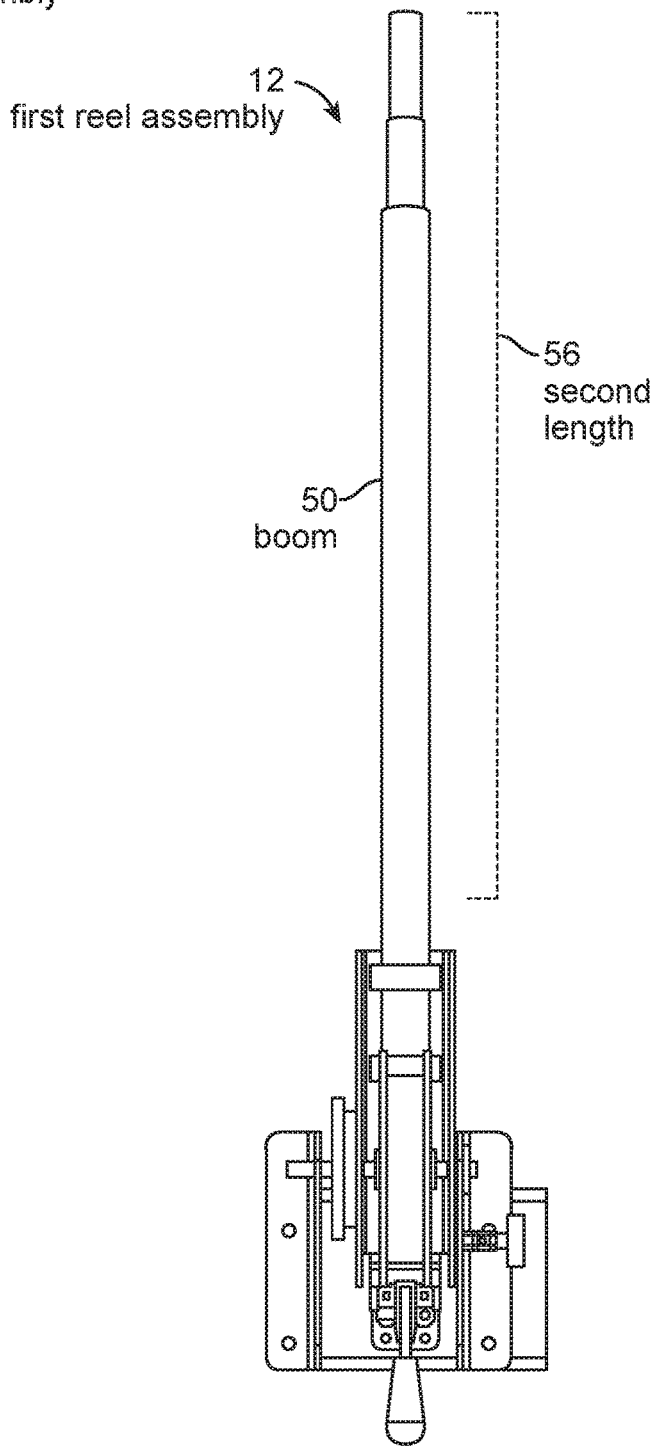
FIG. 4B illustrates a top perspective view of the first reel assembly and boom in a retracted position, according to some embodiments.

FIGS. 4A and 4B illustrate top perspective views of the telescoping boom 50 in an elongated and retracted position, respectively. When in an elongated position the boom 50 may define a first length 54 and when in a retracted position the boom 50 may define a second length 56. In some embodiments the boom 50 may define a length between three and five feet depending on level of elongation or retraction, however, three to five feet is not the only possible length range of the boom 50 in other embodiments. In some embodiments, the boom telescopes to thereby lengthen and shorten to the user's desired length. In some embodiments, the boom 50 comprises one, two, or more different segments that are coupled together to form the boom 50. In this manner, the boom 50 may be bisected. Additionally, the boom 50 may be configured to detach from the watercraft 16. However, it should be appreciated that this is one of many ways the boom may be configured to lengthen and shorten. For example, the boom may comprise separate pieces that can be threadably coupled together to meet the user's desired length. Alternatively, the boom may comprise foldable sections, which can be folded on top of each other to shorten the boom length or unfolded to lengthen the boom.

Figure 5A:
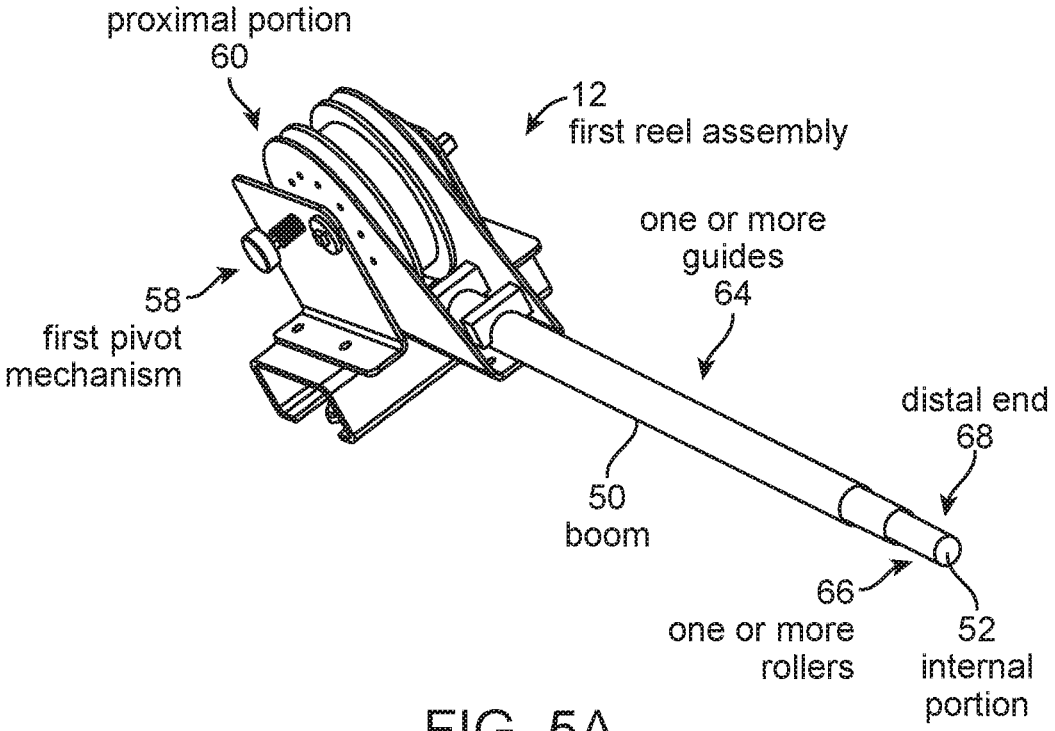
FIG. 5A illustrates an angled side perspective view of the first reel assembly, according to some embodiments.
Figure 5B:
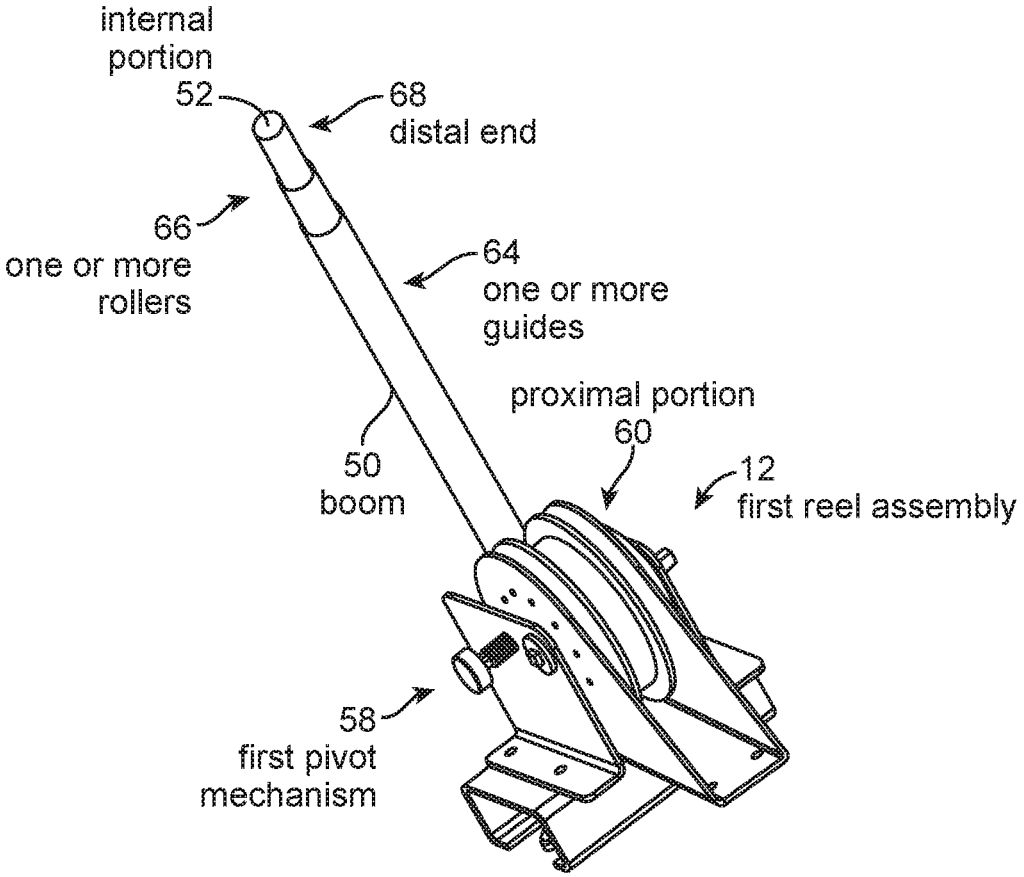
FIG. 5B illustrates a side perspective view of the first reel assembly wherein the first reel assembly and boom are rotated upward, according to some embodiments.

FIGS. 5A and 5B illustrate the rotation ability of the first reel assembly 12, as well as more detail of the components of the boom 50. FIG. 5A shows the boom 50 in a position wherein when the first reel assembly 12 is coupled to the watercraft 16, the boom 50 would extend perpendicular to the side of the watercraft 16, as shown in FIGS. 1A, 1B, 3A, and 6. FIG. 5B shows the first reel assembly 12 rotated so that the boom 50 points upward for greater ease of storage when the first reel assembly 12 is not in use. Alternatively, the boom 50 may be rotated to achieve different angles between the first cord reel 18 and the second cord reel 32, so as to impact the wakesurfing experience for the rider. For example, a rotation position closer to perpendicular to the side 42 of the watercraft 16 may position a rider a different location in the wake than a rotation position that points the boom 50 closer to upward than perpendicular. Rotation is achieved through use of the first pivot mechanism 58, which is shown in FIG. 5A. In some embodiments, the first pivot mechanism 58 may allow for a number of rotation positions, for example, 30°, 60°, 90°, or any other appropriate angle between the boom 50 and the watercraft 16. In some embodiments, the knob component of the first pivot mechanism 58, shown in FIG. 5A, is spring loaded. In some embodiments it may be necessary to unspool the first cord reel 18 from the first spring reel 70 prior to rotation.

FIG. 5A also illustrates that in some embodiments, the boom 50 is hollow to allow the first cord reel 18 to feed through the boom 50 and extend out through the distal end 68. In some embodiments, the first cord reel 18 may exit the distal end 68 at any angle to the distal end 68. For example, the first cord reel 18 may continue straight out of the distal end 68, or the first cord reel 18 may exit at an angle to meet the surf rope 26 and rider at a position at some angle to the boom 50. The distal end 68 may comprise one or more rollers 66 to protect the first cord reel 18 from wear as it extends through the distal end 68, as well as to guide the first cord reel 18 through the boom 50. The internal portion 52 of the boom 50 may comprise one or more guides 64 to help feed the first cord reel 18 through the boom 50, as well as to protect the first cord reel 18 from wear. In some embodiments, the first reel cord 18, second reel cord 32, and/or the surf rope 26 may pass through the internal portion 52 of the boom 50 or an external portion of the boom 50.

FIG. 6 illustrates a perspective view of the wakesurfing system 10 and the axes of rotation for the first reel assembly 12 and the second reel assembly 28. The first reel assembly 12 rotates around a first axis 74, which, in some embodiments, may be the axis traditionally considered the X-axis. The second reel assembly 28 rotates around a second axis 76, which, in some embodiments, may be the axis traditionally considered the Y-axis. FIG. 6 also illustrates greater details of the watercraft 16, including a rear 44 and two possibilities for a side 42. FIG. 6 also illustrates a water surface 78, which may be a lake, ocean, river, or any other suitable body of water.

In some embodiments various components of wakesurfing system 10 may be constructed from metal, hard plastic, or any other durable and/or suitable material. The first cord reel 18 and second cord reel 32, as well as the surf rope 26, may be cylindrical cords and/or ropes in some embodiments. Alternatively, the cord reels 18 and 32 and surf rope 26 may be flat straps or any other suitable composition. In some embodiments, the first cord reel 18, second cord reel 32, and surf rope 26 may or may not all be composed of the same material.

Figure 7:
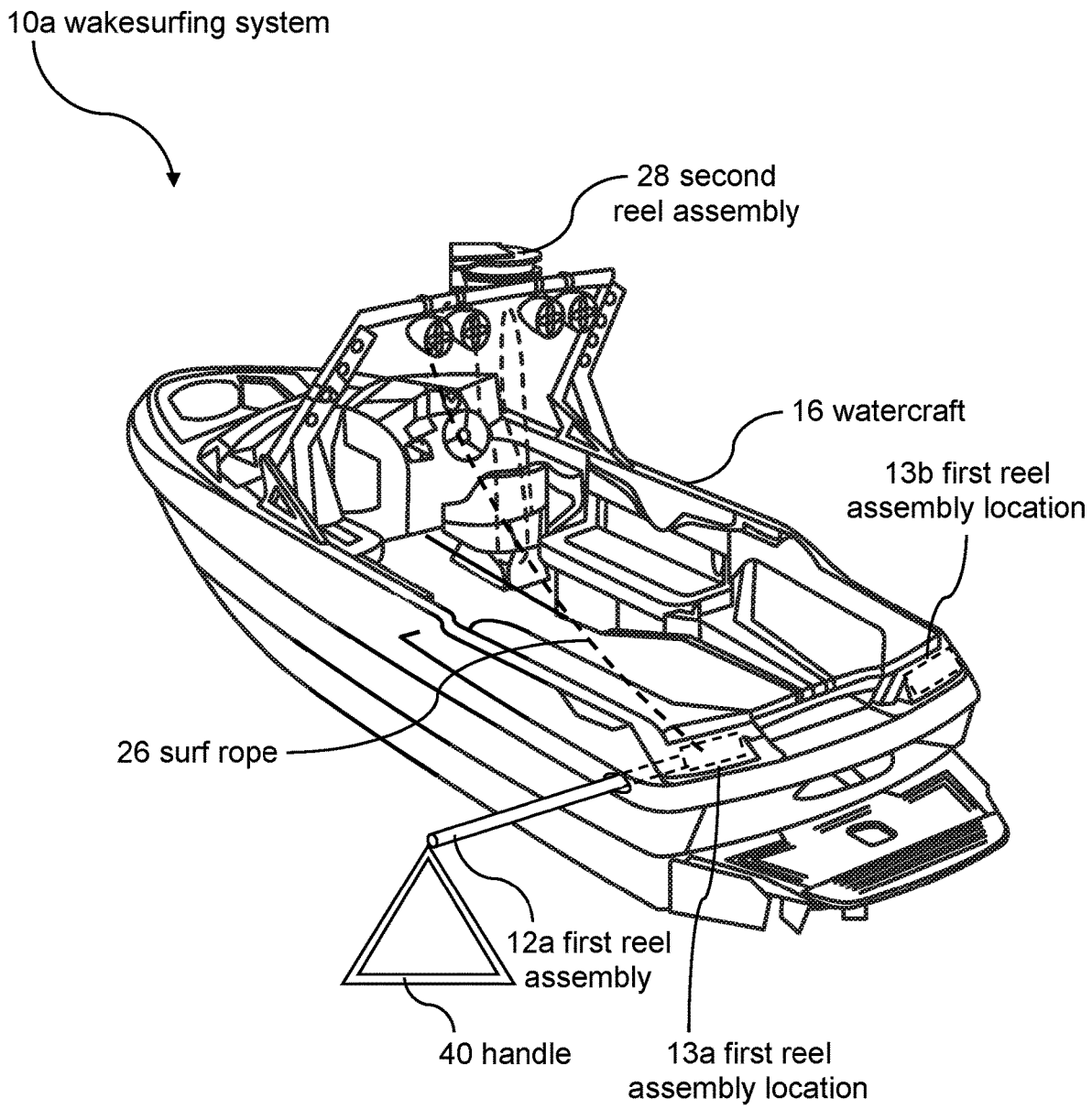
FIGS. 7-9 illustrate perspective views of other wakesurfing systems with the first reel assembly located in various locations on the watercraft, according to some embodiments.
Figure 8:
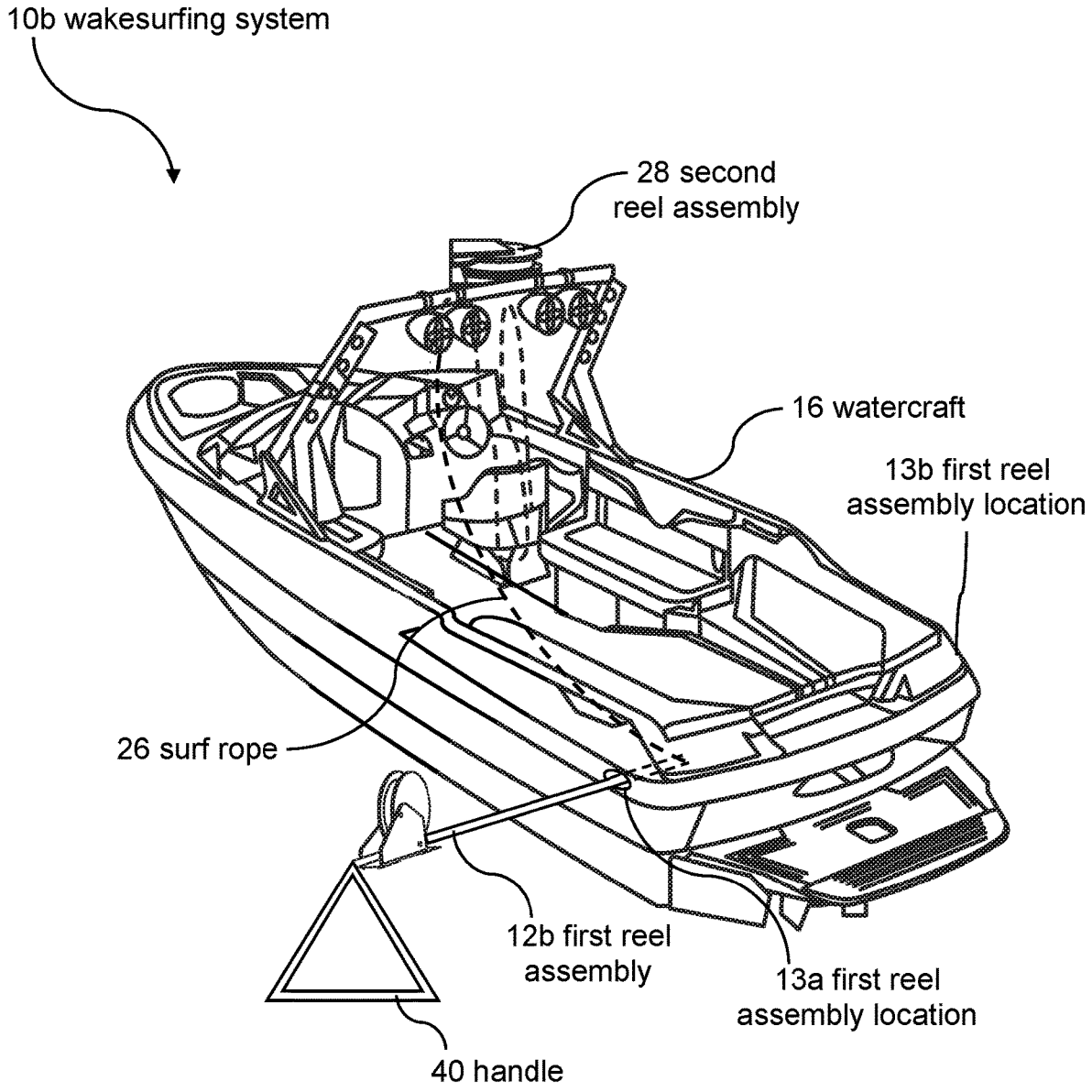
Figure 9:
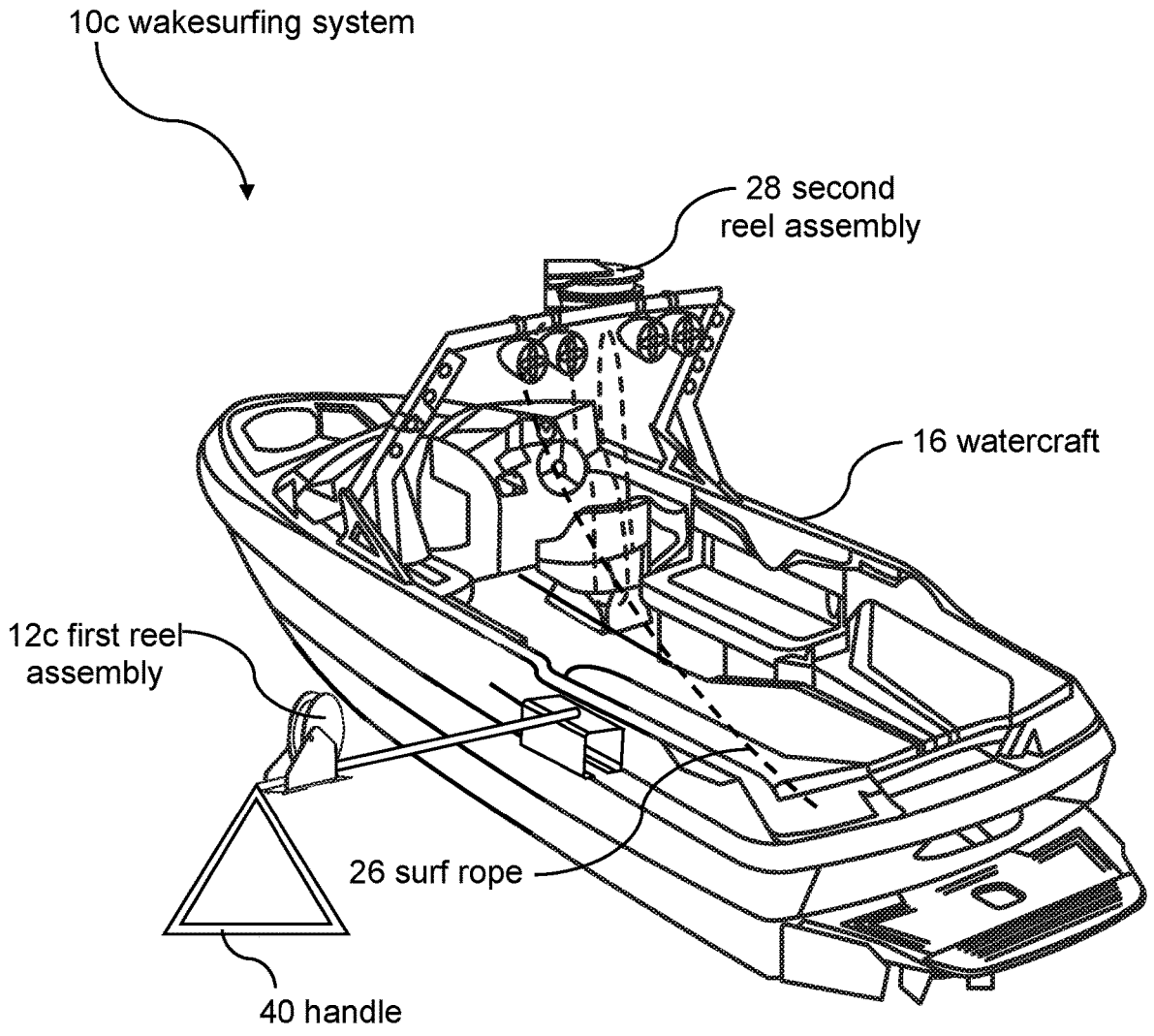

As shown in FIGS. 7-9, the system 10 may be arranged and configured to position the first reel assembly 12 in a variety of locations on the watercraft 16. For example, as illustrated in FIG. 7, the system 10*a* may be configured whereby at least part of the first reel assembly 12*a*, e.g. the reel, is located at least partially within an interior or semi-enclosed portion of the watercraft 16. In this regard, the watercraft 16 may be designed with an aperture extending through the side of the watercraft 16 and an on-board compartment for the first reel assembly 12*a*. It should be appreciated that any portion of the first reel assembly 12*a* may be located within the interior or semi-enclosed portion of the watercraft 16. Furthermore, as shown in FIG. 7, the first reel assembly 12*a* may be located along either side of the watercraft, such as at first reel location 13*a* on a first side of the watercraft or 13*b* located on a second side of the watercraft.

Now with reference to FIG. 8, some embodiments may be designed similar to the embodiment shown in FIG. 7, but instead having the reel located at a distal end of the boom 50. In this regard, less of the first reel assembly 12*b* is located within the interior portion of the watercraft 16. Similar to the embodiment shown in FIG. 7, the first reel assembly 12*b* may be located along either side of the watercraft 16, such as at first reel location 13*a* or 13*b*.

Finally, with reference to FIG. 9, the first reel assembly 12*c* may be implemented as a hybrid version of various embodiments described herein. As shown in FIG. 9, the first reel assembly 12*c* may be physically located in a similar arrangement as disclosed with regards to FIGS. 1-6, but instead having the reel located at a distal end of the boom 50.

INTERPRETATION

Although certain embodiments and examples are disclosed above, inventive subject matter extends beyond the specifically disclosed embodiments to other alternative embodiments and/or uses, and to modifications and equivalents thereof. Thus, the scope of the claims appended hereto is not limited by any of the particular embodiments described above. The structures, systems, and/or devices described herein may be embodied as integrated components or as separate components. Furthermore, various omissions, substitutions, and changes in the form of the methods and systems described herein may be made without departing from the spirit of the inventions disclosed herein.

The section headings and subheadings provided herein are nonlimiting. The section headings and subheadings do not represent or limit the full scope of the embodiments described in the sections to which the headings and subheadings pertain. For example, a section titled "Topic 1" may include embodiments that do not pertain to Topic 1 and embodiments described in other sections may apply to and be combined with embodiments described within the "Topic 1" section.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment.

The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

The term "and/or" means that "and" applies to some embodiments and "or" applies to some embodiments. Thus, A, B, and/or C can be replaced with A, B, and C written in one sentence and A, B, or C written in another sentence. A, B, and/or C means that some embodiments can include A and B, some embodiments can include A and C, some embodiments can include B and C, some embodiments can only include A, some embodiments can include only B, some embodiments can include only C, and some embodiments can include A, B, and C. The term "and/or" is used to avoid unnecessary redundancy. Furthermore, the phrase "at least one of" may be used as a shorthand way of saying "and/or". In this regard, the phrase "at least one of" may mean the same thing as "and/or".

The term "about" is used to mean approximately, and is not intended as a limiting term. For example, claim 14 includes the phrase "wherein the boom defines a length of about 4 feet" and in this context, "about" is not intended to limit the length of the boom to exactly four feet. In this regard, the phrase "wherein the boom defines a length of about 4 feet" may be interpreted to mean that the boom ranges from 3.75 feet to 4.25 feet.

The following is claimed:

1. A wakesurfing system, comprising:

a first reel assembly arranged and configured to couple to a first location on a watercraft;

a first cord reel having a first end arranged and configured to couple to the first reel assembly and a second end arranged and configured to couple to a distal location of a surf rope;

a second reel assembly arranged and configured to couple to a second location on the watercraft; and a second cord reel having a first end arranged and configured to couple to the second reel assembly and a second end arranged and configured to couple to a proximal location of the surf rope.

2. The wakesurfing system of claim 1, wherein the distal location of the surf rope is located adjacent to a handle of the surf rope, and wherein the proximal location is between the distal location and the second reel assembly.

3. The wakesurfing system of claim 1, wherein the first reel assembly and second reel assembly are arranged and configured to retract after a rider releases the surf rope.

4. The wakesurfing system of claim 3, wherein the first reel assembly is arranged and configured to retract the handle back so that the handle is adjacent the first reel assembly.

5. The wakesurfing system of claim 3, wherein the second reel assembly is arranged and configured to retract the proximal location of the surf rope back so that the proximal location is adjacent the second reel assembly and that the surf rope is not located along a side or rear surface of the watercraft.

6. The wakesurfing system of claim 1, wherein the first location is a cleat located on the watercraft and the second location is a tower extending above the watercraft.

7. The wakesurfing system of claim 1, wherein the first reel assembly is arranged and configured to be located closer to a water surface than the second reel assembly.

8. The wakesurfing system of claim 6, wherein the first reel assembly comprises a clamp arranged and configured to couple to the cleat.

9. The wakesurfing system of claim 6, wherein the first reel assembly comprises a boom arranged and configured to allow the first cord reel to pass through an internal portion of the boom.

10. The wakesurfing system of claim 9, wherein the boom comprises one or more guides located along a length of the boom to thereby guide the first cord reel through the boom.

11. The wakesurfing system of claim 10, wherein the boom comprises one or more rollers located at a distal end of the boom to thereby guide the first cord reel out and away from the distal end of the boom.

12. The wakesurfing system of claim 9, wherein the boom is arranged and configured to telescope such that when the boom is in an elongated position the boom defines a first length and when the boom is in a retracted position the boom defines a second length that is shorter than the first length.

13. The wakesurfing system of claim 9, wherein the boom defines a length of about 4 feet.

14. The wakesurfing system of claim 9, wherein the boom is arranged and configured to extend perpendicular to the side of the watercraft.

15. The wakesurfing system of claim 14, wherein the first reel assembly comprises a first pivot mechanism located along a proximal portion of the first reel assembly.

16. The wakesurfing system of claim 15, wherein the first pivot mechanism is arranged and configured to allow for a plurality of rotation positions.

17. The wakesurfing system of claim 15, wherein the first pivot mechanism is arranged and configured to rotate the first reel assembly and boom upward so that the first reel assembly protrudes up and away from the watercraft.

18. The wakesurfing system of claim 1, wherein the first reel assembly is arranged and configured to rotate along a first axis and the second reel assembly is arranged and configured to rotate along a second axis that is different than the first axis.

19. The wakesurfing system of claim 1, wherein the first reel assembly comprises a first spring reel and the second reel assembly comprises a second spring reel.

20. The wakesurfing system of claim 19, wherein the first spring reel produces a tension of about 5 pounds on the first cord reel.

* * * * *